United States Patent [19]

Halpin

[11] Patent Number: 5,056,383

[45] Date of Patent: Oct. 15, 1991

[54] BOTTLE OPENER

[76] Inventor: Harold W. Halpin, 2902 N. 44th La., Phoenix, Ariz. 85031

[21] Appl. No.: 670,563

[22] Filed: Mar. 18, 1991

[51] Int. Cl.[5] ..... B67B 7/18

[52] U.S. Cl. ..... 81/3.43; 81/64

[58] Field of Search ..... 81/3.4, 3.43, 64, 3.07; D8/33, 40, 43

[56] References Cited

U.S. PATENT DOCUMENTS

| | | | |
|---|---|---|---|
| D. 268,164 | 3/1983 | Sandberg | 81/3.43 |
| 2,132,207 | 10/1938 | Donovan | 81/3.43 |
| 2,317,037 | 4/1943 | Donovan | 81/3.43 |
| 3,084,573 | 4/1963 | Lipski | 81/3.43 |
| 4,150,592 | 4/1979 | Mott | 81/64 |
| 4,660,445 | 4/1987 | Windom | 81/3.43 |
| 4,889,018 | 12/1989 | Shaffer | 81/3.43 |

FOREIGN PATENT DOCUMENTS

| | | | |
|---|---|---|---|
| 1782406 | 8/1971 | Fed. Rep. of Germany | 81/3.43 |
| 647271 | 7/1928 | France | 81/64 |

*Primary Examiner*—Roscoe V. Parker

*Attorney, Agent, or Firm*—Richard G. Harrer; Charles E. Cates

[57] ABSTRACT

A twist-cap bottle opener having a handle provided with a bottle cap gripping member attached to one end of the handle. The bottle cap gripping member is generally circular shaped spring-like material, one end of which is attached to an end of the handle. The opposite end of the circular shaped spring material remains unattached and thus the diameter of the cap gripping member can be easily varied to accommodate different sizes of bottle caps or jar lids. The inner surface of the cap gripping member, that is the surface that is in contact with the side of the bottle cap, is provided with projections which act to grip the side of the cap. The unattached or free end of the cap gripping member is bent inwardly to further increase the effectiveness of the opening device.

3 Claims, 1 Drawing Sheet

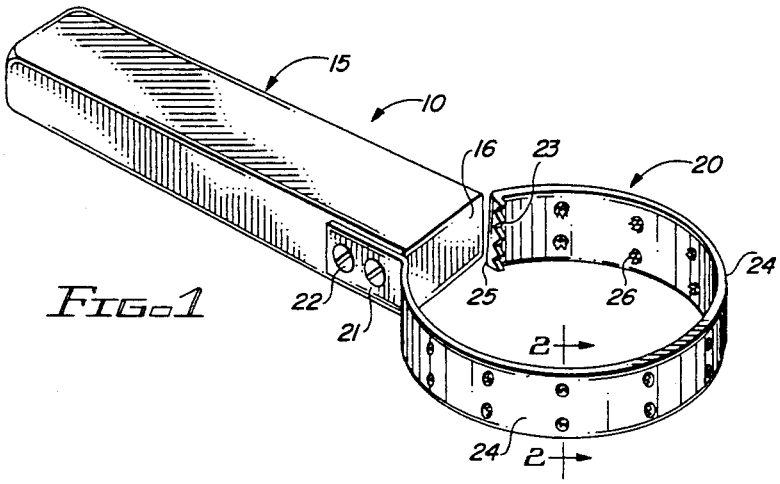
FIG. 1
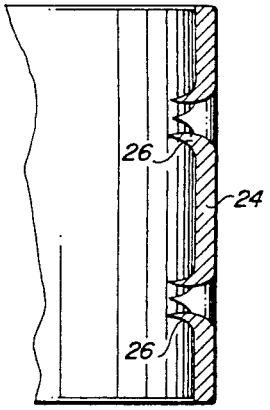
FIG. 2
FIG. 3
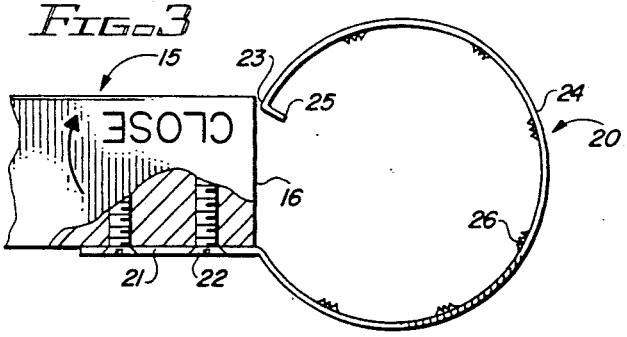
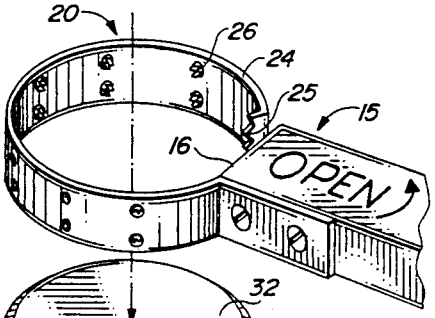
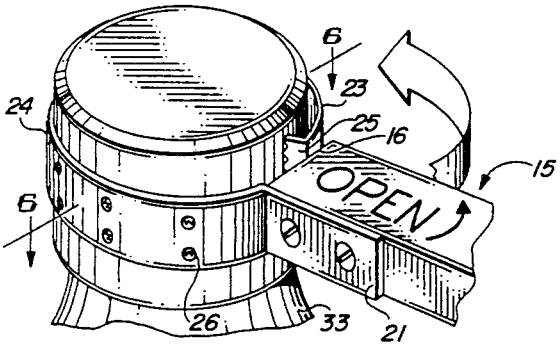
FIG. 5
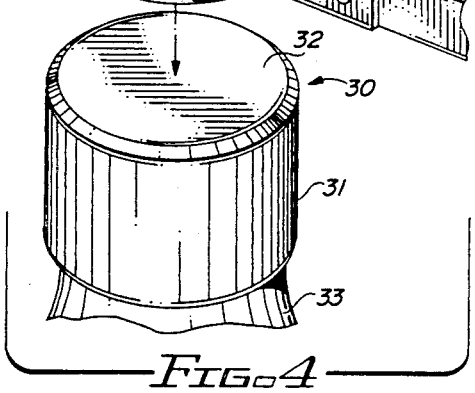
FIG. 4
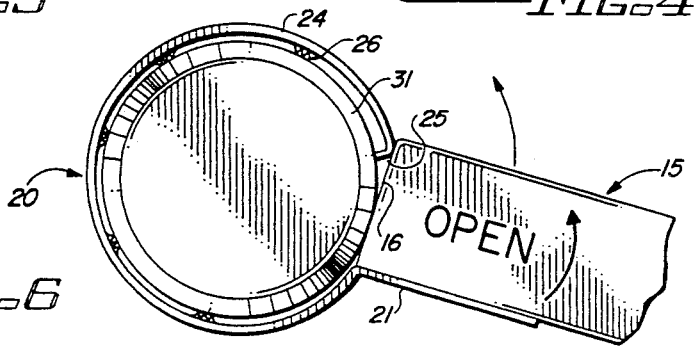
FIG. 6

BOTTLE OPENER

FIELD OF THE INVENTION

The present invention relates generally to a device for removing bottle caps and more specifically to a bottle opener particularly adapted to be used in removing twist-on caps from bottles.

BACKGROUND OF THE INVENTION

In rather recent years, the use of glass and plastic bottles for beverages such as soft drinks has increased tremendously. Virtually all such bottles are sealed by means of a relatively small diameter screw-on or twist-on cap customarily made of metal or plastic. Such twist-on caps enable the user to remove some of the beverage from the bottle and then reseal the bottle to preserve the freshness of the beverage. Although such beverage packaging allows the user to reseal the bottle if desired, and is an efficient means of storing the beverage, such caps can be very difficult to remove by people who lack the necessary hand strength needed to remove the cap. Moreover, if the bottle is to be resealed, some may not have the necessary hand strength to replace the cap to prevent loss of carbonation. In U.S. Pat. No. 4,660,445 there is disclosed a device for removing twist caps on bottles, the device having an enlarged generally dome-shaped housing, with an adjustable clamp secured within the housing for circling various sizes of bottle caps. A remote adjustment handle extends through the housing for adjusting the clamp to fit various cap sizes. Further examples of strap-like wrenches for encircling and removing jar caps are shown in U.S. Pat. Nos. 3,084,573; 2,317,037; 2,132,207 and U.S. Pat. No. 268,164. Although the foregoing opening devices are probably all effective in removing caps or lids from jars or bottles, for the most part they are quite complicated in structure and likely to be rather costly to manufacture.

SUMMARY OF THE INVENTION

This invention provides a twist-cap bottle opener having a handle provided with a bottle cap gripping means attached to one end of the handle. The bottle cap gripping means is a generally circular shaped spring-like material, one end of which is attached to an end of the handle. The opposite end of the circular shaped spring material remains unattached and thus the diameter of the cap gripping means can be easily varied to accommodate different sizes of bottle caps or jar lids. The inner surface of the cap gripping means, that is the surface that is in contact with the side of the bottle cap, is provided with projections which act to grip the side of the cap. The unattached or free end of the cap gripping means is bent inwardly to further increase the effectiveness of the opening device.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood in the following description taken in connection with the accompanying drawings in which like parts are given like identification numerals and wherein:

FIG. 1 is a perspective view of the bottle opener;

FIG. 2 is a sectional view taken on the line 2—2 of FIG. 1;

FIG. 3 is a partial bottom view of the bottle opener;

FIG. 4 is a partial perspective view of the bottle opener about to be placed on a bottle;

FIG. 5 is a partial perspective view of the bottle opener positioned on the cap of the bottle and in position to remove the cap; and FIG. 6 is a sectional view taken on the line 6—6 of FIG. 5.

BRIEF DESCRIPTION OF THE PREFERRED EMBODIMENT

Referring now to FIG. 1, the bottle opener which is shown generally at 10 includes a handle 15 provided with a cap gripping means shown generally at 20. Cap gripping means 20 includes a generally circular shaped band 24 formed of a relatively thin, spring-like material, with end 21 of band 24 securely attached to one end of handle 15 by means of screws 22. As shown, circular band 24 constitutes an arc of about 360 degrees and in any event it should form an arc of at least about 180 degrees. Band 24 is preferably made of spring steel having a thickness of about 0.016 inches. As show best in FIG. 2, the side of band 24 is pierced to provide the inner surface of the band, that is the surface which contacts the cap, with a series of spaced apart and inwardly facing projections 26 which act as gripping teeth. The free end 23 of circular band 24 is bent inwardly at an angle of about 90 degrees and the very end of the band is then notched to provide additional gripping teeth 25.

In use and to aid in the removal of a twist cap from a bottle, as shown in FIG. 4, the cap gripping means 20 is centered over a bottle 33 having cap 30. It will be seen that in this embodiment the word "OPEN" and an arrow is imprinted on one side of handle 15. With this side of the handle in an "up" position, thereafter, as shown in FIG. 5, the opener is lowered onto cap 30 so that band 24 of cap ripping means 20 surrounds the periphery 31 of the cap and is in contact therewith. To continue the procedure of removing the cap and as shown in FIG. 5, the handle is grasped and turned in a counter-clockwise direction as indicated by the arrow on handle 15. The shoulder 16 is in contact with the periphery of the cap. For removal of the commonly used twist caps on beverage bottles, the diameter of the cap gripping means 20 ranges from about 1 to 1½ inches. To remove the cap, the band 24 and its attendant projections 26 and teeth 25 should make good contact with the periphery of the cap and the shoulder 16 of handle 15 contacts the periphery of the cap. If the diameter of the cap gripping means is somewhat larger than the actual diameter of the cap, appropriate contact of the band with the cap may be made by using the fingers to reduce the diameter of the cap gripping means 20. Since the band 24 is made of a spring-like material which has a considerable degree of flexibility, it is relatively easy for the user to reduce the diameter of the gripping means 20 by moving the free end of the band 24 in a clockwise direction.

After good contact has been made between the band and the periphery of the cap, movement of the handle in a counterclockwise direction will result in removal of the cap with considerably less hand strength required.

As will be seen in FIG. 3, the bottle opening device of this invention can also be used to reseal a cap on a bottle and this is done by merely turning the device 180 degrees so that the word "CLOSE" and an arrow which is printed on the reverse side of the handle is readable. In this position, the handle is moved on a clockwise direction ensuring that a good seal is obtained by the cap on the bottle.

While this invention has been described in detail to particular reference to a preferred embodiment, it will be understood that variations and modifications can be effective within the scope of the invention as described hereinbefore and is defined in the following claims.

What is claimed is:

1. A tool for attaching and removing twist caps from containers comprising a handle, cap gripping means attached to one end of said handle, said cap gripping means further comprising a generally circular shaped band formed of a relatively thin, spring-like material, one end of which is attached to said handle with the opposite end thereof being unattached, the surface of said band which is in contact with said cap being provided with gripping means, with the unattached end of said band being bent inwardly to provide additional gripping means.

2. The tool of claim 1 wherein said band is made of spring steel and constitutes an arc of at least about 180° and wherein said unattached end of said band is bent inwardly at an angle of about 90°.

3. The tool of claim 2 wherein said band constitutes an arc of about 360° and wherein said gripping means includes a series of spaced apart inwardly facing projections.

* * * * *